US005581651A

United States Patent [19]

Ishino et al.

[11] Patent Number: 5,581,651

[45] Date of Patent: Dec. 3, 1996

[54] SPEECH SIGNAL DECODING APPARATUS AND METHOD THEREFOR

[75] Inventors: Toshiyuki Ishino; Akihiko Sugiyama, both of Tokyo, Japan

[73] Assignee: NEC Corporation, Japan

[21] Appl. No.: 270,502

[22] Filed: Jul. 5, 1994

[30] Foreign Application Priority Data

Jul. 6, 1993 [JP] Japan ..... 5-166735

[51] Int. Cl.[6] ..... G10L 3/02; G10L 9/00

[52] U.S. Cl. ..... 395/2.14; 395/2.15; 395/2.35; 395/2.36; 395/2.37; 395/2.38; 395/2.39

[58] Field of Search ..... 395/2.14, 2.15, 395/2.35, 2.36, 2.37, 2.38, 2.39, 2.17, 2.74, 2.75, 2.77; 381/36, 37

[56] References Cited

U.S. PATENT DOCUMENTS

| | | | |
|---|---|---|---|
| 4,216,354 | 8/1980 | Esteban et al. | 179/15.55 |
| 4,790,015 | 12/1988 | Callens et al. | 381/31 |
| 4,831,624 | 5/1989 | McLaughlin et al. | 371/37 |
| 5,150,387 | 9/1992 | Yoshikawa et al. | 375/122 |
| 5,384,793 | 1/1995 | Zinser | 371/69.1 |
| 5,471,558 | 11/1995 | Tsutsui | 395/2.28 |

FOREIGN PATENT DOCUMENTS 62-285541 12/1987 Japan .

*Primary Examiner*—Allen R. MacDonald
*Assistant Examiner*—Patrick N. Edouard
*Attorney, Agent, or Firm*—Laff, Whitesel, Conte & Saret, Ltd.

[57] ABSTRACT

A speech signal decoding apparatus includes a decoding section, an error check section, a data memory, a white noise generating section, a switch group, and a frequency region synthesizing filter bank. The decoding section separates a received code string into the 0th to nth sub-band signals and decodes them. The data memory outputs the decoded signals with a delay. The white noise generating section outputs white noise signals of the (m+1)th to nth sub-bands which are level-adjusted in accordance with the average power of the decoded signal of each sub-band. The switch group selects/outputs the decoded signals of the 0th to nth sub-bands when a control signal representing an error is not output, and selects/outputs the delayed and decoded signals of the 0th to mth sub-bands and the level-adjusted white noise signals of the (m+1)th to nth sub-bands when a control signal representing an error is output. The frequency region synthesizing filter bank outputs a reproduced speech signal on the basis of the selected outputs of the 0th to nth sub-bands. A speech signal decoding method is also disclosed.

6 Claims, 3 Drawing Sheets

SPEECH SIGNAL DECODING APPARATUS AND METHOD THEREFOR

BACKGROUND OF THE INVENTION

The present invention relates to a data interpolation method for a decoding apparatus and, more particularly, to a speech signal decoding apparatus using a data interpolation method for a frame data error in transmitting coded data obtained by decomposing a signal (to be transmitted) into frequency regions, i.e., sub-band-coded data, and a method therefor.

Conventionally, in transmitting an input signal, e.g., a speech signal, as coded data having a frame structure, when a transmission path error is detected at the receiving end, data of a frame containing the transmission path error is lost, and the coded data of the frame is replaced with data of the previous frame which was received without an error. With this operation, error data interpolation is performed.

For example, in the technique disclosed in Japanese Patent Laid-Open No. 62-285541, an input speech signal is divided into frames at predetermined time intervals, and a parity bit is added to a parameter representing the characteristic feature of speech data in each frame, thus transmitting the speech signal as data having a frame structure. When a transmission path error in the data of a given frame is detected by a parity bit check at the receiving end, the parameter of the frame is replaced with the parameter of the previous frame, thus performing decoding processing. With this processing, a deterioration in the quality of decoded speed due to a transmission path error is reduced.

The above method can be easily applied to sub-band-coded speech data. If, however, this method is simply applied to sub-band-coded data, the following problem is left unsolved.

In this conventional method, in place of a frame in which a transmission path error has occurred, frame data of the immediately preceding frame is repeatedly decoded. When a speech signal is divided into frequency regions, the low-frequency speech signal component of a frame in which a transmission path error has occurred is rarely replaced with a completely different signal component because low-frequency speech signal components have a high correlation on the time axis. However, the possibility that a high-frequency speech signal component as frame data of a frame in which a transmission path error has occurred is replaced with a different signal component is high because high-frequency speech signal components have a lower time correlation than low-frequency components. For this reason, in the conventional method, the high-frequency component of a frame immediately preceding a frame in which a transmission path error has occurred is also reproduced as decoded data, and the data is detected as high-frequency component noise.

SUMMARY OF THE INVENTION

It is an object of the present invention to provide a speech signal decoding apparatus which reduces a deterioration caused by a transmission path error in the quality of reproduced speech, and a method therefor.

It is another object of the present invention to provide a speech signal decoding apparatus which reduces a deterioration caused by interpolation of error data in the quality of a high-frequency component, and a method therefor.

In order to achieve the above objects, according to the present invention, there is provided a speech signal decoding apparatus comprising decoding means for separating a received code string of frames into 0th to nth sub-band signals, and decoding each sub-band signal, the received code string being obtained by dividing a frequency band of a speech signal into (n 1) sub-bands, from a 0th sub-band to an nth sub-band counted from a low-frequency side, at a transmitting end, coding a signal component of each sub-band, and multiplexing the coded data of the respective sub-bands at predetermined time intervals, error check means for detecting an error from the received code string and outputting a control signal representing the error, delay means for outputting decoded signals of 0th to mth ($0<m<n$) sub-bands from the decoding means upon delaying each of the decoded signals by at least a one-frame period, white noise output means for level-adjusting the decoded signals of the (m+1)th to nth sub-bands supplied from the decoding means between an immediately preceding frame and a frame N frames ahead thereof in accordance with a value representing average power of each of the decoded signals, and outputting level-adjusted white noise signals of the (m+1)th to nth sub-bands, switch means, constituted by (n +1) switches, from 0th to nth switches, each having first and second input terminals, the first input terminals of the 0th to nth switches receiving the decoded signals of the 0th to nth sub-bands from the decoding means, the second input terminals of the 0th to mth switches receiving the delayed decoded signals of the 0th to mth sub-bands from the delay means, and the second input terminals of the (m+1)th to nth switches receiving the level-adjusted white noise signals of the (m+1)th to nth sub-bands from the white noise output means, for causing each switch to output the signal supplied to the first input terminal when the control signal from the error check means indicates the absence of an error, and causing each switch to output the signal supplied to the second input terminal when the control signal from the error check means indicates the presence of an error, and frequency region synthesizing means for outputting a reproduced speech signal on the basis of outputs from the 0th to nth switches of the switch means.

DESCRIPTION OF THE PREFERRED EMBODIMENTS

Figure 2:
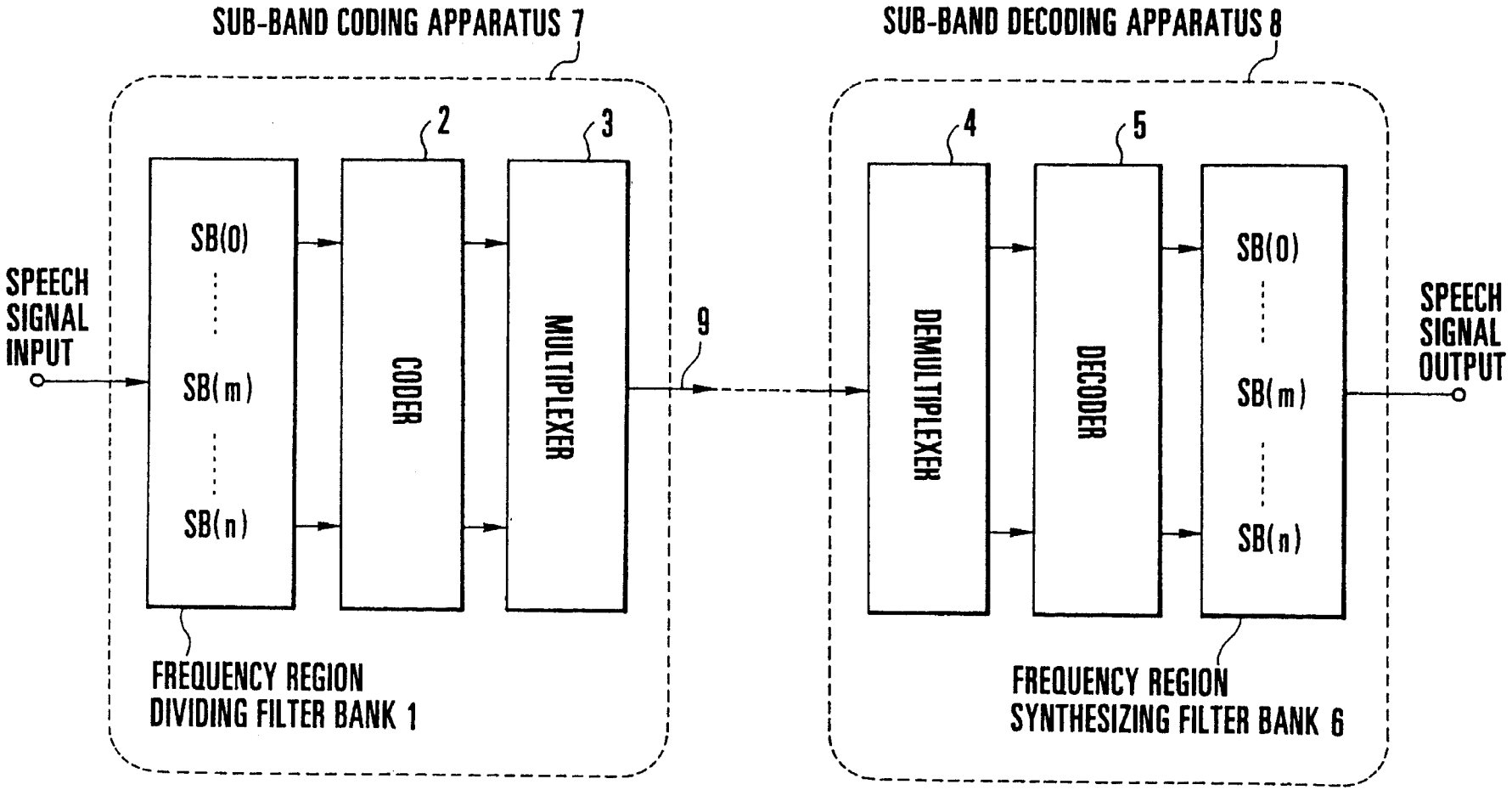
FIG. 2 is a schematic block diagram showing a transmission system having a general arrangement constituted by a sub-band coding apparatus and a decoding apparatus.

Prior to a description of embodiments of the present invention, a transmission system for performing sub-band coding/decoding operations, to which the present invention is applied, will be described first with reference to FIG. 2. FIG. 2 shows a transmission system having a general arrangement constituted by a sub-band coding apparatus 7 and a sub-band decoding apparatus 8.

In the sub-band coding apparatus 7, a speech signal input to a frequency region dividing filter bank 1 is divided into (n+1) sub-bands SB(0), SB(1), . . . , SB(n), and each sub-band is supplied to a coder 2 after being frequency-shifted to a low-frequency band. The coder 2 codes, e.g., quantizes, a signal which is divided into sub-bands and parallel input, and supplies the coded data to a multiplexer 3. The multiplexer 3 multiplexes and transmits the parallel input coded data to a transmission path 9.

In the sub-band decoding apparatus 8, a demultiplexer 4 separates the code string received from the transmission path 9 into code strings in units of sub-bands, and supplies the code strings to a decoder 5. The decoder 5 outputs signals corresponding to the respective sub-bands upon performing reverse processing to that performed by the coder 2, and supplies the signals to a frequency region synthesizing filter bank 6. The frequency region synthesizing filter bank 6 reproduces a speech signal from the signals corresponding to the respective sub-bands.

Figure 1:
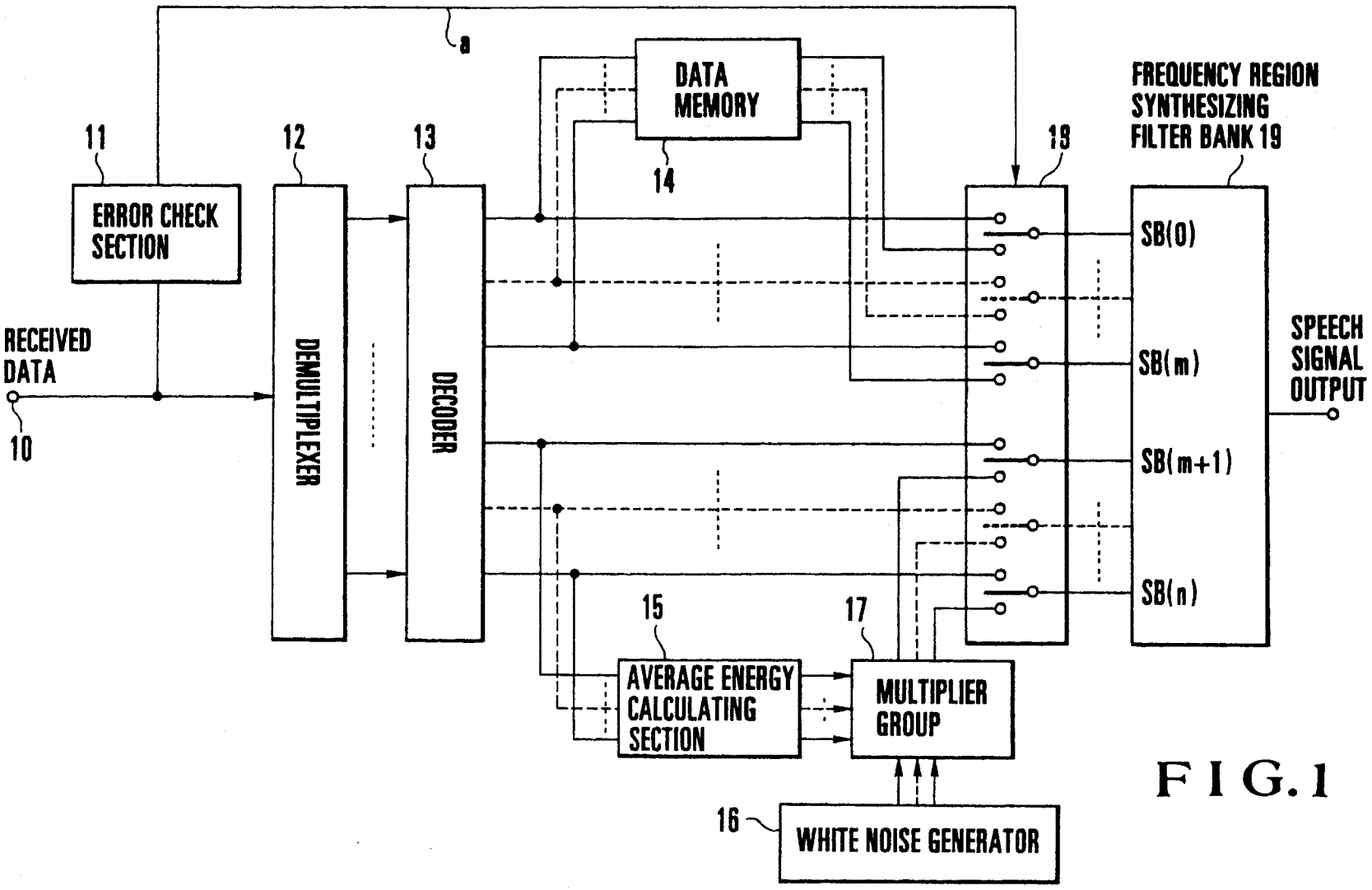
FIG. 1 is a block diagram showing a decoding apparatus according to an embodiment of the present invention.

An embodiment of the present invention will be described next with reference to the accompanying drawings. FIG. 1 shows a decoding apparatus according to an embodiment of the present invention. This apparatus includes an error check section 11, a demultiplexer 12, a data memory 14 as a delay means, an average energy calculating section 15, a white noise generator 16, a multiplier group 17 as a level adjusting means, and a switch group 18. The error check section 11 performs an error check on received data input to an input terminal 10. The demultiplexer 12 divides the received data into data portions in units of sub-bands. The data memory 14 is constituted by a RAM (Random Access Memory) and designed to hold data of an immediately preceding frame on the low-frequency region side. The average energy calculating section 15 calculates the average energy (power) of each sub-band on the high-frequency side. The white noise generator 16 generates white noise in a high-frequency region. The multiplier group 17 controls the amplitude of white noise in accordance with the average energy obtained by the average energy calculating section 15. The switch group 18 is constituted by switches $SW_o$ to $SW_n$ and designed to switch data to be input to a frequency region synthesizing filter bank 19 depending on the presence/absence of a transmission path error.

In addition, the decoding apparatus includes a demultiplexer 12, a decoder 13, and a frequency region synthesizing filter bank 19. The demultiplexer 12 separates a code string, received from a transmission path, into code strings in units of sub-bands. The decoder 13 decodes the parallel code strings from the demultiplexer 12 and outputs the resultant signals of the respective sub-bands parallelly. The frequency region synthesizing filter bank 19 reproduces a speech signal on the basis of the signals of the respective sub-bands from the decoder 13 which are input upon being switched by the switch group 18 or output signals from the data memory 14 and the multiplier group 17. Note that the operations of the demultiplexer 12, the decoder 13, and the frequency region synthesizing filter bank 19 are the same as those of the demultiplexer 4, the decoder 5, and the frequency region synthesizing filter bank 6 shown in FIG. 2.

The operation of the decoding apparatus having the above arrangement will be described next.

The error check section 11 performs an error check on received data. When a frame containing an error is detected, a switch control signal a representing the frame containing the error is supplied to the switch group 18. The data memory 14 delays each of data of sub-bands SB(0), . . . , SB(m) (0<m<n) on the low-frequency side, output from the decoder 13, by a one-frame period, and supplies the data to the second inputs of the 0th to mth switches $SW_o$ to $SW_m$ of the switch group 18, respectively.

Data of sub-bands SB(m+1), . . . , SB(n) on the high-frequency side from the decoder 13 are supplied to the average energy calculating section 15. The average energy calculating section 15 calculates the average energy of each of the sub-bands supplied between the immediately preceding frame and a frame N frames ahead thereof, and outputs an average value corresponding to the amplitude of the average energy of each sub-band to the multiplier group 17.

The white noise generator 16 generates a white noise output with respect to each of the sub-bands SB(m+1), . . . , SB(n) input to the average energy calculating section 15, and supplies the white noise outputs to the multiplier group 17. The multiplier group 17 multiplies the average values output from the average energy calculating section 15 and corresponding to the sub-bands SB(m+1), . . . , SB(n) and the white noise outputs from the white noise generator 16, and outputs the white noise level-adjusted in accordance with the average power of each sub-band of the received data for each of the sub-bands SB(m+1), . . . , SB(n). The multiplier group 17 supplies the level-adjusted white noise outputs to the second inputs of the (m+1)th to nth switches $SW_{m+1}$, . . . , $SW_m$ in the switch group 18.

Note that the decoded outputs of the respective sub-bands from the decoder 13 are respectively supplied to the first input terminals of the 0th to nth switches $SW_o$ to $SW_m$ in the switch group 18. Each of the switches $SW_o$ to $SW_n$ in the switch group 18 supplies an output from the decoder 13 to the frequency region synthesizing filter bank 19 when a switch control signal from the error check section 11 is set at high level, i.e., no error is contained in the corresponding frame. When the switch control signal a is set at low level, i.e., an error is contained in the corresponding frame, the 0th to mth switches $SW_o$ to $SW_m$ supply outputs from the data memory 14, i.e., the data of the corresponding sub-frame of the previous frame, to the frequency region synthesizing filter bank 19; and the (m+1)th to nth switches $SW_{m+1}$ to $SW_n$ supply outputs from the multiplier group 17, i.e., the white noise outputs level-adjusted for each sub-band, to the frequency region synthesizing filter bank 19.

In this case, as the frequency region synthesizing filter bank 19, an inverse DCT converter is used when DCT (Discrete Cosine Transform) is used as the transmitting end, i.e., the frequency region dividing filter bank 1 in FIG. 2; and an inverse wavelet converter is used when a wavelet converter is used as the filter bank 1.

A switch control signal will be described below. Upon detection of a transmission path error in a given frame, the error check section 11 generates a signal which is set at low level at the timing when the data of the corresponding frame is supplied to the switch group 18, and outputs it as a switch control signal a. In supplying the sub-band data of the frame containing the transmission error to the frequency region synthesizing filter bank 19, the switch group 18 supplies the data of the previous frame for low-frequency components SB(0), . . . , SB(m), and the white noise outputs level-adjusted in accordance with the data up to the previous frame for high-frequency components SB(m+1), . . . , SB(n), thereby outputting reproduced speech.

As described above, according to the embodiment shown in FIG. 1, for the low-frequency components of the sub-band data of a frame containing a transmission path error, the data of the previous frame is supplied to the frequency region synthesizing filter bank 19; and for the high-frequency components of the sub-band data, level-adjusted white noise outputs are supplied to the frequency region synthesizing filter bank 19, thereby providing naturally reproduced speech.

When sub-band data is supplied from a transmission path in which many transmission errors occur, reception may be performed with transmission errors being contained in consecutive frames. In this case, in the embodiment shown in FIG. 1, with respect to the second and subsequent frames of the consecutive frames in which the errors have been detected, sub-band data containing errors are supplied from the data memory 14 to the switch group 18. For this reason, in this case, the quality of reproduced speech deteriorates. The second embodiment shown in FIG. 3 is designed to solve this problem.

Figure 3:
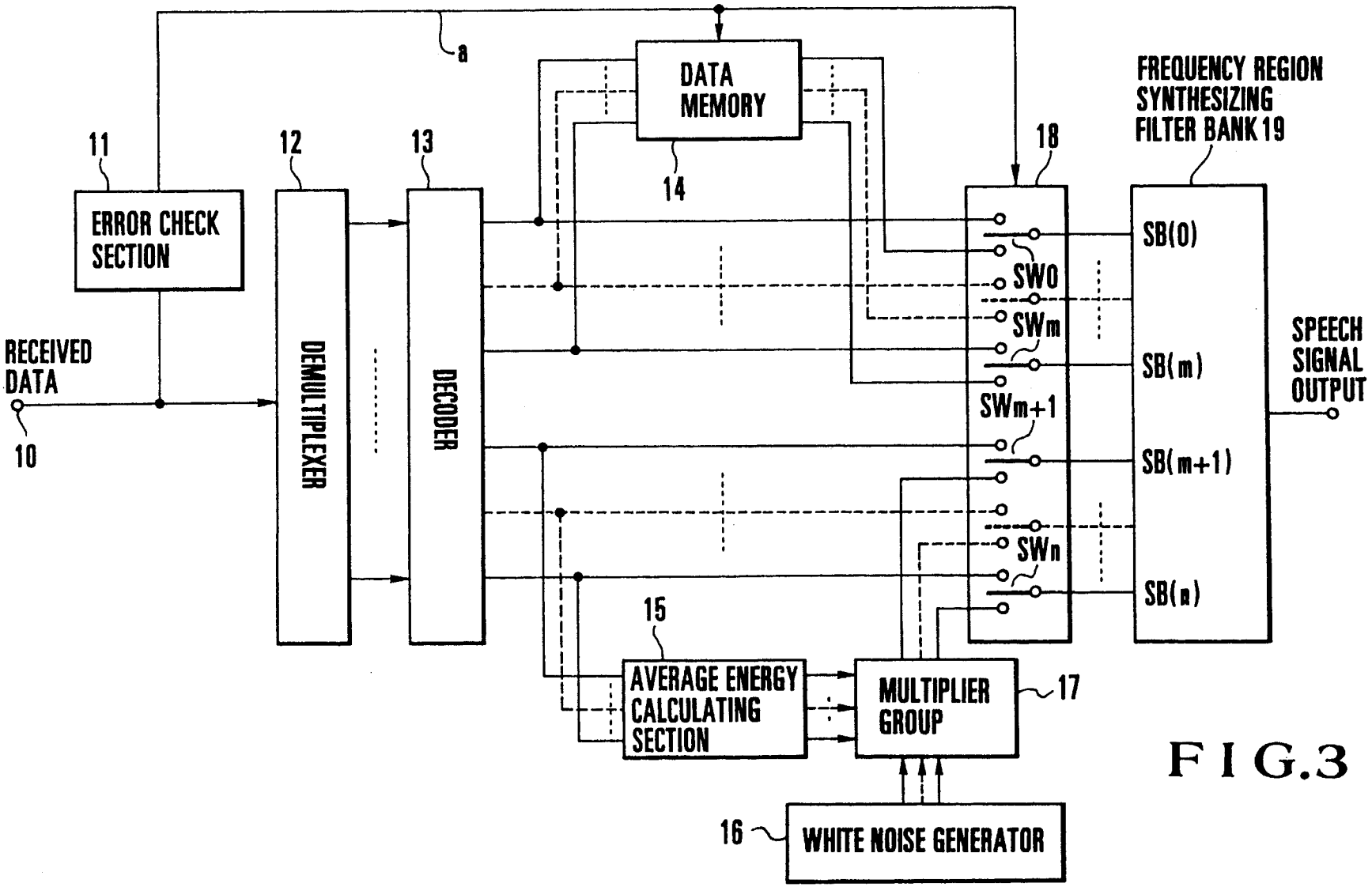
FIG. 3 is a block diagram showing a decoding apparatus according to the second embodiment of the present invention.

The second embodiment is different from the embodiment shown in FIG. 1 in that a switch control signal is supplied to a data memory 14 as well as a switch group 18, as shown in FIG. 3. When a switch control signal a is set at low level, sub-band data is not supplied from a decoder 13. That is, since no sub-band data of frames containing errors are written in the data memory 14, the data memory 14 repeatedly outputs the data of frames near the frames containing the errors to the switch group 18. As a result, no data of the frames containing the errors are supplied to the frequency region synthesizing filter bank 19 via switches $SW_o$ to $SW_m$ of the switch group 18. Therefore, the above problem can be solved.

As has been described above, even if a frame data error occurs, data correction can be performed to naturally reproduce data.

What is claimed is:

1. A speech signal decoding apparatus comprising:

decoding means for separating a received code string of frames into 0th to nth sub-band signals, and decoding each sub-band signal, the received code string being obtained by dividing a frequency band of a speech signal into (n+1) sub-bands, from a 0th sub-band to an nth sub-band counted from a low-frequency side, at a transmitting end, coding a signal component of each sub-band, and multiplexing the coded data of the respective sub-bands at predetermined time intervals;

error check means for detecting an error from the received code string and outputting a control signal representing the error;

delay means for outputting decoded signals of 0th to mth (0<m<n) sub-bands from said decoding means upon delaying each of the decoded signals by at least a one-frame period;

white noise output means for level-adjusting the decoded signals of the (m+1)th to nth sub-bands supplied from said decoding means between an immediately preceding frame and a frame N frames ahead thereof in accordance with a value representing average power of each of the decoded signals, and outputting level-adjusted white noise signals of the (m+1)th to nth sub-bands;

switch means, constituted by (n+1) switches, from 0th to nth switches, each having first and second input terminals, the first input terminals of said 0th to nth switches receiving the decoded signals of the 0th to nth sub-bands from said decoding means, the second input terminals of said 0th to mth switches receiving the delayed decoded signals of the 0th to mth sub-bands from said delay means, and the second input terminals of said (m+1)th to nth switches receiving the level-adjusted white noise signals of the (m+1)th to nth sub-bands from said white noise output means, for causing each switch to output the signal supplied to the first input terminal when the control signal from said error check means indicates the absence of an error, and causing each switch to output the signal supplied to the second input terminal when the control signal from said error check means indicates the presence of an error; and frequency region synthesizing means for outputting a reproduced speech signal on the basis of outputs from said 0th to nth switches of said switch means.

2. An apparatus according to claim 1, wherein said white noise output means comprises average power calculating means for receiving the decoded signals of the (m+1)th to nth sub-bands from said decoding means, calculating average power of the decoded signal of each of the sub-bands, supplied between an immediately preceding frame to a frame N frames ahead thereof, and outputting each calculated value as average power of each of the (m+1)th to nth sub-bands, white noise generating means for generating white noise signals of the (m+1)th to nth sub-bands, and level adjusting means for level-adjusting the white noise signals of the (m+1)th to nth sub-bands from said white noise generating means in accordance with the average power of each of the (m+1)th to nth sub-bands, and outputting the signals as level-adjusted white noise signals of the (m+1)th to nth sub-bands.

3. An apparatus according to claim 1, wherein said delay means comprises a data memory for storing the decoded signals of the 0th to mth sub-bands from said decoding means, and reading out and outputting the stored decoded signals one frame after the signals are stored.

4. An apparatus according to claim 3, wherein the control signal from said error check means is also input to said data memory, and said data memory stops storing the decoded signals of the 0th to mth sub-bands and repeatedly outputting an immediately preceding stored decoded signal of a frame containing no error for each frame.

5. A speech signal decoding apparatus comprising:

separating means for separating a received code string of frames into 0th to nth sub-band signals, the received code string being obtained by dividing a frequency band of a speech signal into (n+1) sub-bands, from a 0th sub-band to an nth sub-band counted from a low-frequency side, at a transmitting end, coding a signal component of each sub-band, and multiplexing the coded data of the respective sub-bands at predetermined time intervals;

decoding means for decoding the 0th to nth sub-band signals from said separating means;

error check means for detecting an error from the received code string and outputting a control signal representing a frame containing the error;

a data memory for storing decoded signals of 0th to mth (0<m<n) sub-bands from said decoding means, and reading out and outputting the decoded signals one frame after the signals are stored;

average power calculating means for receiving the decoded signals of the (m+1)th to nth sub-bands from said decoding means, calculating average power of the decoded signal of each of the sub-bands, supplied between an immediately preceding frame to a frame N frames ahead thereof, in units of sub-bands, and outputting the calculated values as average power of each of the (m+1)th to nth sub-bands;

white noise generating means for generating white noise signals of the (m+1)th to nth sub-bands;

level adjusting means for level-adjusting the white noise signals of the (m+1)th to nth sub-bands from said white noise generating means in accordance with the average power of the (m+1)th to nth sub-bands, and outputting the signals as level-adjusted white noise signals of the (m+1)th to nth sub-bands;

switch means, constituted by (n+1) switches, from 0th to nth switches, each having first and second input terminals, the first input terminals of said 0th to nth switches receiving the decoded signals of the 0th to nth sub-bands from said decoding means, the second input terminals of said 0to mth switches receiving the delayed decoded signals of the 0to mth sub-bands from said delay means, and the second input terminals of said (m+1)th to nth switches receiving the level-adjusted white noise signals of the (m+1)th to nth sub-bands from said white noise output means, for causing each switch to output the signal supplied to the first input terminal when the control signal from said error check means indicates the absence of an error, and causing each switch to output the signal supplied to the second input terminal when the control signal from said error check means indicates the presence of an error; and frequency region synthesizing means for outputting a reproduced speech signal on the basis of outputs from said 0th to nth switches of said switch means.

6. A speech signal decoding method comprising the steps of:

separating a received code string of frames into 0th to nth sub-band signals, the received code string being obtained such that a frequency band of a speech signal is divided into (n+1) sub-bands, from a 0th sub-band to an nth sub-band counted from a low-frequency side, at a transmitting end to code a signal component of each sub-band, and the coded data of the respective sub-bands are multiplexed at predetermined time intervals;

decoding the 0th to nth sub-band signals in unit of sub-bands;

detecting an error from the received code string and outputting a control signal representing the error;

outputting decoded signals of 0th to mth ($0<m<n$) sub-bands upon delaying each of the decoded signals by at least a one-frame period;

outputting level-adjusted white noise signals of (m+1)th to nth sub-bands in accordance with a value representing average power of each of decoded signals of the (m+1)th to nth sub-bands, supplied between an immediately preceding frame to a frame N frames ahead thereof;

selecting and outputting the decoded signals of the 0th to nth sub-bands when a control signal representing an error is not output;

selecting and outputting the decoded signals of the 0th to mth sub-bands delayed by at least a one-frame period, and the level-adjusted white noise signals of the (m+1)th to nth sub-bands when a control signal representing an error is output; and outputting a reproduced speech signal on the basis of selected outputs of the 0th to nth sub-bands.

* * * * *